United States Patent [19]

Baumstimler

[11] 4,043,150

[45] Aug. 23, 1977

[54] SAFETY SLEEVE

[76] Inventor: August B. Baumstimler, P.O. Box 832, Odessa, Tex. 79760

[21] Appl. No.: 661,691

[22] Filed: Feb. 26, 1976

[51] Int. Cl.[2] ..... F16D 3/84

[52] U.S. Cl. ..... 64/32 R; 64/4; 64/23; 166/311; 175/219

[58] Field of Search ..... 64/32 R, 23, 23.7, 6, 64/4; 175/219, 321; 166/311

[56] References Cited

U.S. PATENT DOCUMENTS

| | | | |
|---|---|---|---|
| 1,541,007 | 6/1925 | Thiemer | 64/32 R |
| 2,108,947 | 2/1938 | Seifer | 125/219 |
| 2,116,290 | 5/1938 | Spicer | 64/23 |
| 3,078,933 | 2/1963 | Orner | 175/219 |
| 3,446,283 | 5/1969 | Baumstimler | 166/311 |

*Primary Examiner*—Samuel Scott
*Assistant Examiner*—Randall Heald
*Attorney, Agent, or Firm*—Wendell Coffee

[57] ABSTRACT

A safety sleeve shields the working members of a well tool wherein two shoulders come together to eliminate the possibility of workmen loosing a finger between the two shoulders.

5 Claims, 2 Drawing Figures

SAFETY SLEEVE

BACKGROUND OF THE INVENTION:

1. Field of the Invention.

This invention relates to safety shields for oil well tools.

2. Description of the Prior Art.

When a well is drilled, there are tools operated within the well to perform many different functions. These include for example, setting and removing plugs and bridges, fracturing, acid treating, cleaning out, cementing, perforating, etc.

Those skilled in the art know that many of these tools have sliding or telescoping members by which certain functions are performed. These functions include opening or closing valves, grasping or releasing fishing necks, setting or releasing slips, etc. Often these telescoping members have external shoulders which come together when the two members are telescoped.

When the tool is on the drilling rig floor, being hoisted and lowered by lines from the derrick, often the bottom of the tool is set down and the members will telescope together. In many cases workmen are positioning a tool to one side of the well and sometimes will carelessly have their hands where the tool telescopes together. Inasmuch as these tools are quite heavy this can result in painful injury or even the loss of fingers.

Specifically, a commonly used tool is a "clean-out tool," a typical example of such tool is shown in my previous patents tabulated below.

U.S. Pat. Nos. 3,406,757, October 22, 1968; 3,446,283, May 27, 1969; 3,651,867, March 28, 1972.

As may be seen, to open the hydrostatic valve of the clean out tool, the two upper members of the tool telescope together, each member has a shoulder which comes together with the other.

SUMMARY OF THE INVENTION:

1. New and Different Function.

I have invented a sleeve to cover portions of tools shown in my previous patents and all similar well tools. This sleeve threads to one of the members and surrounds or telescopes over the other member. The outside diameter is the same as the tool itself so there is no possibility of getting it caught or forming an obstruction as it goes into or comes out of the well.

2. Objects of this Invention.

An object of this invention is to increase the safety of working conditions for people working on wells.

Other objects are to achieve the above with a device that is sturdy, compact, durable, lightweight, simple, safe, efficient, versatile, and reliable, yet inexpensive and easy to manufacture and install.

The specific nature of the invention, as well as other objects, uses, and advantages thereof, will clearly appear from the following description and from the accompanying drawing, the different views of which are not to scale.

Figure 1:
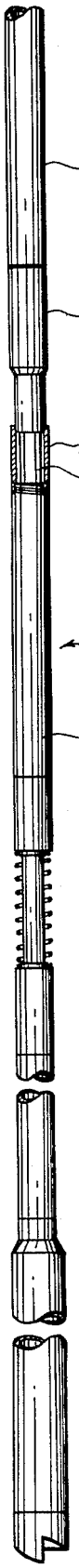
FIG. 1 is a side elevational view of a tool with an embodiment of my invention shown in cross section thereon. The total length of the tool has been foreshortened for clarity.

DESCRIPTION OF THE PREFERRED EMBODIMENT:

Referring to the drawing, there may be seen general clean out tool 10 which, in this case, is particularly adapted for cleaning debris from the bottom of an oil well. It is also useful in retrieving or lifting certain other elements from the oil well which might not be technically considered as debris.

It is specifically shown in my previous patents a tool has certain internal valves which are opened or closed by setting the weight of string 12 upon body member 14 of the tool. This causes the portion called head member 16 to telescope downwardly so hexagon portion 18 telescopes within the body member 14. The head member 16 has shoulder 20 at the top of the hexagon portion 18. The body member 14 has shoulder 22 at its upper edge. The shoulders 20 and 22 form a stop, limiting the movement of the head member 16 and the body member 14 together. As will be understood, the hexagon member 18 is a portion of the head member 16 and slidingly received within the body member 14.

For this invention, thin sleeve 24 is attached to the body member 14. It is conveniently attached by placing external threads 26 upon the top of the body member 14. The threads 26 are recessed sufficiently so the outside diameter of the sleeve 24 is the same as the outside diameter of the body member 14. The outside diameter of the body member 14 and head member 16 are the same and, therefore, the sleeve does not change the outside diameter so the tool can be inserted and removed from the well as easily within the sleeve 24 as without.

The head member 16 is recessed at 28 for the sleeve member to slide smoothly up and down. To eliminate the possibility that top edge 30 of the sleeve would pinch a finger with the top of the recess 28, the top of the recess is a tapered shoulder 32 so that if a finger were in this area at the time the members telescoped together, the finger would be pushed out of the way rather than pinched.

Figure 2:
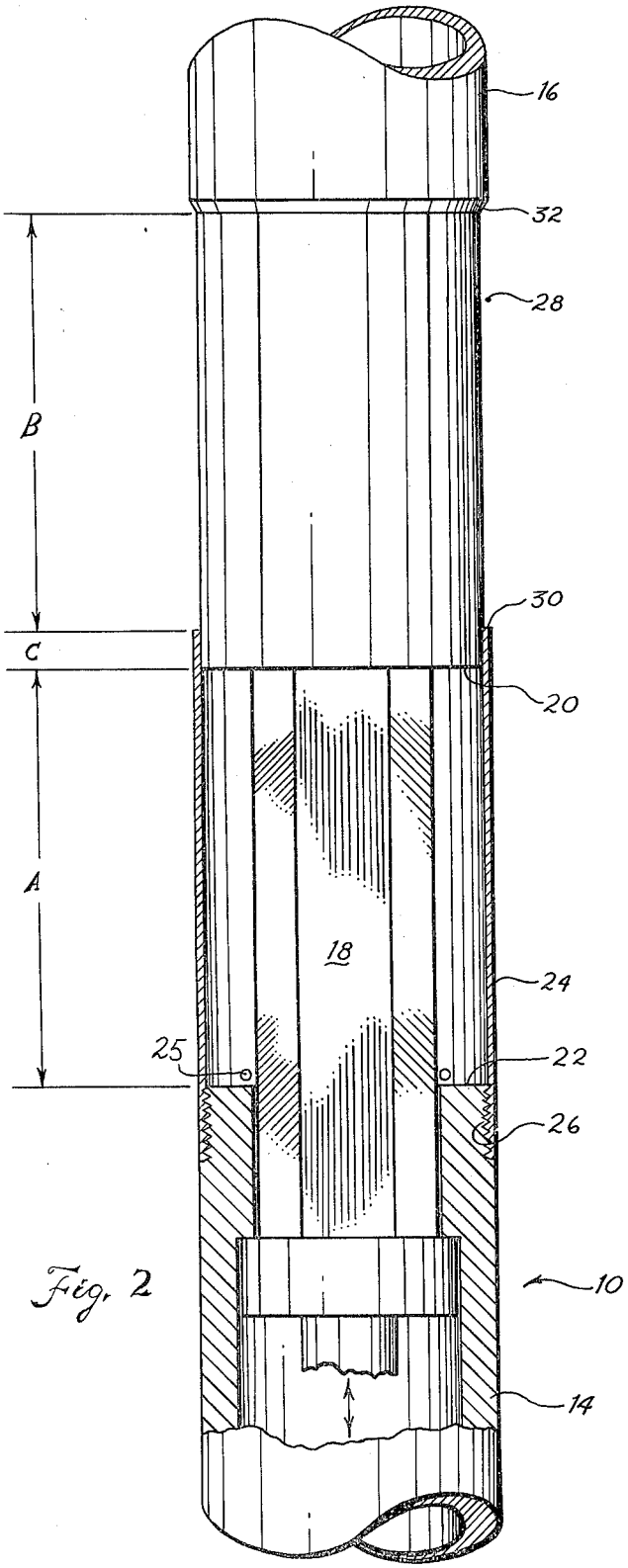
FIG. 2 is an enlarged portion of that tool showing the particular part with the embodiment thereon, with parts broken away to better illustrate the invention.

Referring more particularly to the drawing, it may be seen when the members are fully extended or apart there is a distance of travel "A" between the two shoulders. If the sleeve is made slightly longer than this so there is an overlap distance of "C" this will be the distance from the shoulder 22 to the top edge 30. Therefore, if the sleeve fits snugly against or reaches to the tapered shoulder 32, it may be seen that the travel of the sleeve will be the distance B on FIG. 2 of the drawing. Also, it will be evident that the distance A will equal the distance "B" and that the overlap C remains the same. Therefore, the length of the recessed portion will be at least equal to the distance from the shoulder of the threaded member to the end of the sleeve. In actual practice, the distance from the top of the sleeve 30 to the tapered shoulder 32 may be greater than the distance of travel so that when the two shoulders 20 and 22 are together, there is still clearance between the top of the sleeve and the tapered shoulder 32. I.e., the length of the recessed portion is at least equal to the distance from the shoulder of the threaded member, which is as illustrated the body member 14, to the end of the sleeve.

Holes 25 in the sleeve 24 just above the threads 26 permit fluid flow.

As an aid to correlating the terms of the claims to the exemplary drawing, the following catalog of elements is provided:

10 tool
12 string
14 body member
16 head member
18 hexagon portion
20 head shoulder
22 body shoulder
24 sleeve
25 holes
26 threads
28 recess
30 top of sleeve
32 tapered shoulder
A travel
B recess
C overlap The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

SUBJECT MATTER CLAIMED FOR PROTECTION:

I claim as my invention:

1. In a clean out well tool for removing debris from a well, said tool having a. an elongated tubular body member,
b. a tubular head member,
c. said members slidingly telescoped together,
d. a body shoulder on the body member,
e. a head shoulder on the head member,
f. said shoulders coming together to form a stop to limit the sliding telescoping movement between the members;
g. THE IMPROVED SAFETY DEVICE COMPRISING IN COMBINATION WITH THE ABOVE:
h. a sleeve attached to one of said members,
i. holes in the sleeve,
j. said sleeve telescoped over the other member.

2. The invention as defined in claim 1 with an additional limitation of k. said members and said sleeve all having the same outside diameter.

3. The invention as defined in claim 2 with additional limitations of m. a recessed portion on the member over which said sleeve telescopes, and
n. a tapered shoulder between the recessed portion and the portion of the member having an outside diameter equal to that of the sleeve.

4. The invention as defined in claim 3 with an additional limitation of o. said length of the recessed portion at least equal to the distance from the shoulder of the attached member to the end of the sleeve.

5. The invention as defined in claim 4 wherein said attachment of the sleeve is by threaded joint.

* * * * *